US005785127A

United States Patent [19]

Miller, Sr.

[11] Patent Number: 5,785,127

[45] Date of Patent: Jul. 28, 1998

[54] USER BACK-MOUNTED FIRE SUPPRESSOR

[76] Inventor: Willie Westley Miller, Sr., 630 St. James St., New Orleans, La. 70130

[21] Appl. No.: 539,669

[22] Filed: Oct. 5, 1995

[51] Int. Cl.[6] ..... A62C 15/00

[52] U.S. Cl. ..... 169/71; 169/75; 169/76; 169/77

[58] Field of Search ..... 169/43, 46, 47, 169/30, 71, 75, 76, 77; 239/152, 153, 154; 222/175; 224/148.2, 148.7, 201, 262, 265, 637

[56] References Cited

U.S. PATENT DOCUMENTS

| | | | |
|---|---|---|---|
| 1,370,768 | 3/1921 | Sperling | 224/201 |
| 2,463,736 | 3/1949 | Benson | 239/154 |
| 2,606,701 | 8/1952 | Huthsing | 224/148.4 |
| 2,822,054 | 2/1958 | Howard | 169/71 X |
| 3,045,761 | 7/1962 | Ciarlo | 169/71 X |
| 3,721,299 | 3/1973 | Roessler | 169/77 |
| 3,802,511 | 4/1974 | Good, Jr. | 169/30 |
| 4,254,833 | 3/1981 | Perry | 169/76 |
| 5,018,584 | 5/1991 | Tomlinson | 169/30 |
| 5,123,491 | 6/1992 | Luchs | 169/47 X |

FOREIGN PATENT DOCUMENTS

| | | | |
|---|---|---|---|
| 1295158 | 11/1972 | United Kingdom | 169/77 |

*Primary Examiner*—Andrew C. Pike
*Attorney, Agent, or Firm*—Joseph N. Breaux

[57] ABSTRACT

A pressurized fire suppressor is provided of the type mountable on a user's back for selectively discharging a fire suppressant toward a fire, and which has a reservoir for holding the fire suppressant under pressure. The fire suppressor comprises: a high pressure tank defining a reservoir therein for holding a fire suppressant, the tank having a fill spout defining a fill opening and an outlet; a filler cap connectable to the fill spout for sealingly covering the fill opening; a valve in fluid connection with the tank, the valve is connectable with a source of pressurized fluid for pressurizing the tank; a flexible conduit having a first and second connector end, the first connector end in fluid connection with the outlet of the tank; a suppressant discharge head for selectively discharging the fire suppressant from the tank, the suppressant discharge head in connection with the second connector end of the flexible conduit; and a back mounting apparatus connected to the tank.

8 Claims, 3 Drawing Sheets

USER BACK-MOUNTED FIRE SUPPRESSOR

TECHNICAL FIELD

The present invention relates to devices and methods for extinguishing fires and more particularly to devices and methods for extinguishing fires that has a fire suppressor mountable on a user's back in which a fire suppressant may be pressurized within the tank of the fire suppressor.

BACKGROUND ART

Over the years there have been many proposals for extinguisher equipment for use in fighting unwanted fires. One common type of extinguisher is the self-contained pressurized container. These extinguishers can be effective for fighting small fires around the home, office, or vehicles. However, these devices hold only a small volume of suppressant and are not adequate for larger fires, such as those around the home when trash burning gets out of control or other localized fires. Moreover, these devices are expensive and difficult to recharge; some must be returned to a recharge station, incurring additional expense and often rendering the extinguisher useless for periods of time.

Another type of extinguisher consists of a tank mountable on the back of a user, for holding a suppressant, and a pump for pressurizing and discharging the suppressant. These devices are often used for fighting brush fires and the like. These devices therefore are bulky, expensive, and require a trainer to use.

It would be a benefit, therefore, to have a fire suppressor which would allow a lay user to extinguish a localized fire. It would be a further benefit to have a fire suppressor that may be filled with an inexpensive fire suppressant such as sand. It would be an additional benefit to have a fire suppressor that may be pressurized easily and by a common source of pressurized fluid such as an air compressor.

GENERAL SUMMARY DISCUSSION OF INVENTION

It is thus an object of the invention to provide a fire suppressor that has a high pressure tank mountable on a user's back.

It is a further object of the invention to provide a fire suppressor that has a suppressant discharge head for selectively discharging a fire suppressant.

It is a still further object of the invention to provide a fire suppressor that has a fill spout for filling the tank with a common, inexpensive fire suppressant such as sand.

It is a still further object of the invention to provide a fire suppressor that has a valve in fluid connection with the tank for pressurizing the fire suppressant from a common source of pressurized fluid such as an air compressor.

Accordingly, a pressurized fire suppressor is provided of the type mountable on a user's back for selectively discharging a fire suppressant toward a fire, and which has a reservoir for holding the fire suppressant under pressure. The fire suppressor comprises: a high pressure tank defining a reservoir therein for holding a fire suppressant, the tank having a fill spout defining a fill opening and an outlet; a filler cap connectable to the fill spout for sealingly covering the fill opening; a valve in fluid connection with the tank, the valve being connectable with a source of pressurized fluid for pressurizing the tank; a flexible conduit having a first and second connector end, the first connector end in fluid connection with the outlet of the tank; a suppressant discharge head for selectively discharging the fire suppressant from the tank, the suppressant discharge head in connection with the second connector end of the flexible conduit; and a back mounting apparatus connected to the tank.

The tank is a high pressure tank which is constructed of metal having a wall thickness sufficient for withstanding at least 125 p.s.i. The tank may be rectangular or substantially round. Preferably, the tank is constructed as a unitary piece to reduce the risk of having a weak seam. The tank defines at least one fill opening and at least one outlet.

The fire suppressant may be any type of suppressant known in the art for extinguishing a fire. The fire suppressant may be injected into the tank under pressure through the valve. The fire suppressant may include a dry element such as sand which may loaded into the tank through the fill opening in the fill spout. The dry element is pressurized and carried by a fluid such as air, carbon dioxide, or water.

The valve may be any type valve known in the art which allows for injecting a pressurized fluid into the tank. The valve may be a ball valve, a "quick-connect" type valve or connection, or a needle type valve. The valve may extend through any section of the tank.

A pressure gauge may be connected to the tank in a manner for determining the pressure within the tank. The pressure gauge may be removably connected. Preferably, the pressure gauge is connected to the tank in close proximity to the valve for constant viewing while pressurizing the tank.

The back mounting apparatus may be a frame connected to the tank having shoulder straps and a belt for maintaining the frame on the back of the user. The frame may include a first frame member having a first curved section and a second frame members having a second curved section, the first and second frame member being spaced parallel to one another and connected vertically along a front surface of the tank, the first and second curved sections extending away from the front surface adjacent a top section of the tank.

For convenience, the fire suppressor may have a handle connected to a top section of the tank. The handle provides an easy means of moving the fire suppressor and an alternative to mounting the fire suppressor on the user's back. For further convenience in storing the fire suppressor, legs may extend from the base section of the tank for standing the tank in a vertical position. The legs may further include horizontal foot members for providing stability to the standing tank.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

BEST MODE FOR CARRYING OUT THE INVENTION

Figure 1:
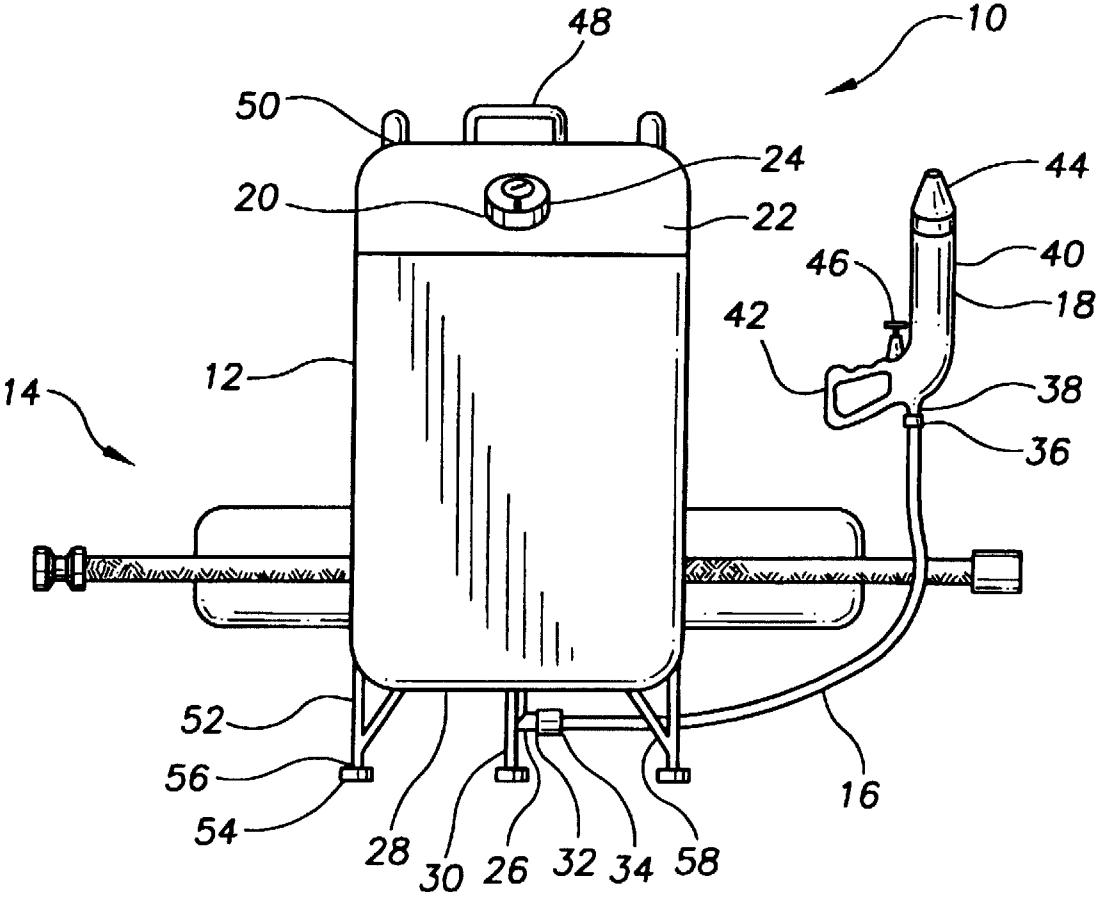
FIG. 1 is a rear view of an exemplary embodiment of the fire suppressor of the present invention.

FIG. 1 is a rear view of an exemplary embodiment of the fire suppressor of the present invention generally designated by the numeral 10. Fire suppressor 10 includes a high pressure tank 12 defining a reservoir, a back mounting apparatus generally designated 14, a flexible conduit 16, and a suppressant discharge head 18.

Tank 12 is constructed of stainless steel and is provided as a reservoir for storing sand under pressure for use as a fire suppressant. Tank 12 is a high pressure tank capable of withstanding pressures up to 300 pounds per square inch.

Tank 12 has a fill spout 20 defining a fill opening therethrough for loading sand into tank 12. Fill spout 20 is formed by the rear surface 22 of tank 12. A filler cap 24 is provided for sealingly covering the fill opening when desired and for exposing the fill opening when alternatively desired. Filler cap 24 is internally threaded for sealing attachment to the externally threaded fill spout 20.

Fire suppressant is discharged from tank 12 through a conduit connector 26, having a fluid passage therethrough, extending from a base section 28 of tank 12. Conduit connector 26 is a ninety degree, stainless steel ell having a first end opening 30 and second end opening 32. First end opening 30 is in fluid connection with an outlet (not shown) formed by base section 28 and is welded thereto. Second end opening 32 is externally threaded for attachment of a male connector.

Flexible conduit 16 is a high pressure hose capable of withstanding pressures up to 300 pounds per square inch. Flexible conduit 16 has a first and second connector end 34,36. First connector end 34 is a male connector internally threaded for attachment to second end opening 32 of conduit connector 26 forming a fluid connection with the reservoir of tank 12. Second connector end 36 is a male connector internally threaded for connecting suppressant discharge head 18.

Suppressant discharge head 18 is a triggerable spray wand having a female connector end 38 companionately threaded for attachment to second connector end 36 of flexible conduit 16. Suppressant discharge head 18 has a enlarged barrel 40 and a pistol grip 42 for better control by the user when fire suppressant is being discharged. Fire suppressant is selectively discharged from the nozzle end 44 when a user (not shown) depresses the trigger 46.

A handle 48 is connected by welding to a top section 50 of tank 12 permitting easier transporting of tank 12. Three legs 52 extend vertically, downward from base section 28. A horizontal foot member 54 is connected to the terminal end 56 of each leg 52. A cross member 58 is connected between each leg 52 and base section 28 for additional support. Legs 52 permit vertical storage and transport of tank 12 while protecting conduit connector 26 from damage.

Figure 2:
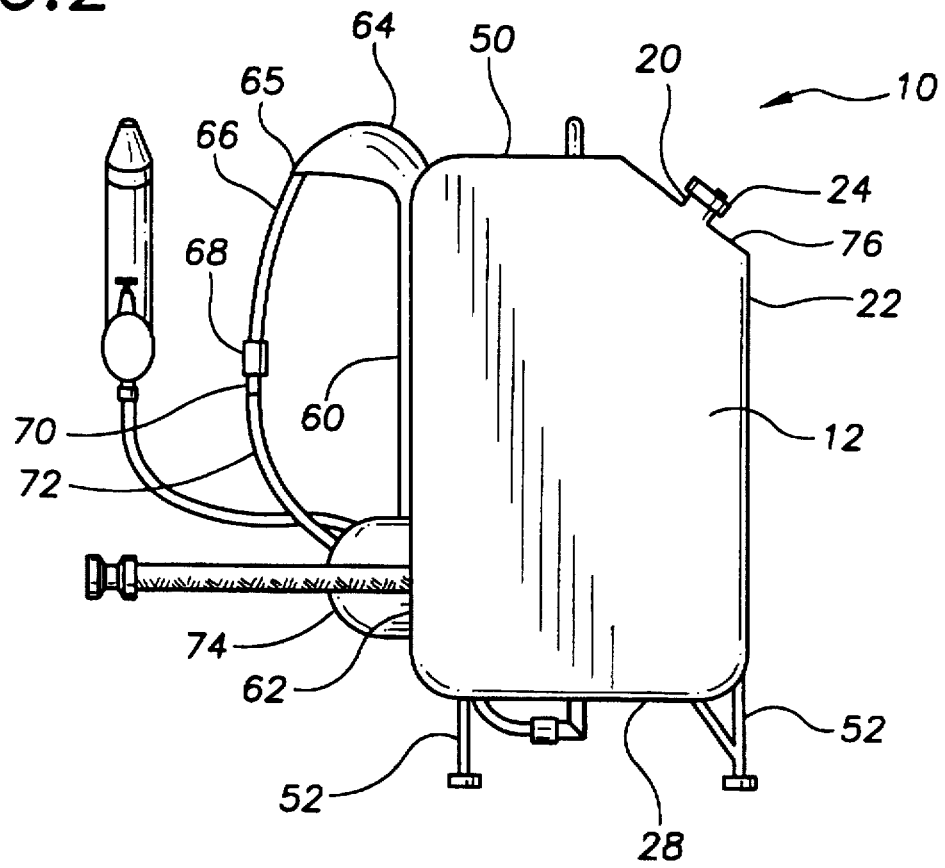
FIG. 2 is a side view of the fire suppressor.

FIG. 2 is a side view of fire suppressor 10. FIG. 2 shows a first frame member 60 made of aluminum, welded vertically along the front surface 62 of tank 12. First frame member 60 has a padded first curved section 64 for resting atop a user's shoulder. A first top shoulder strap 66 having a buckle end 68 extends from the distal end 65 of first curved section 64. As shown, buckle end 68 is connected to a tongue end 70 of a first bottom shoulder strap 72. First bottom shoulder strap 72 is connected to a waist band 74 by stitching.

Rear surface 22 forms an angled section 76 to top section 50. Fill spout 20 extends from angled section 76 at an angle of forty-five degrees from horizontal for disposing sand into tank 12. Filler cap 24 is shown threadedly connected to fill spout 20 sealingly covering the fill opening through fill spout 20.

Two legs 52 are spaced and extend from base section 28 adjacent front surface 62. A third leg 52 is centered and extends from base section 28 adjacent rear surface 22.

Figure 3:
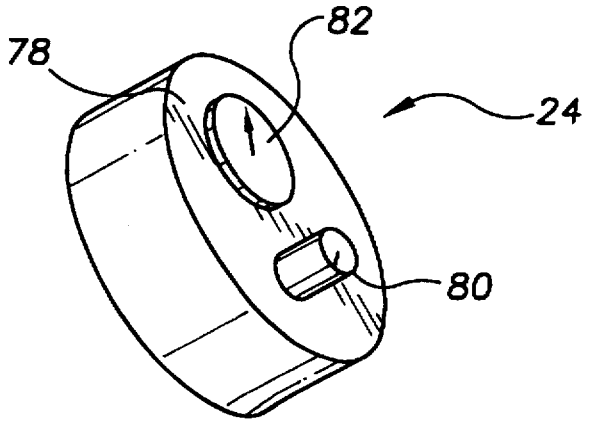
FIG. 3 is an isometric view of the filler cap in isolation.

FIG. 3 is an isometric view of filler cap 24 in isolation. Filler cap 24 is constructed of stainless steel and has internal threading for sealingly connecting to fill spout 20 (FIG. 2). Filler cap 24 has a planar top surface 78. A valve 80 extends through top surface 78 and is connected to filler cap 24 by welding so as to be in fluid connection with the reservoir of tank 12 when filler cap 24 is threaded onto fill spout 20. Valve 80 is a needle valve adapted for connection with a pressurized fluid source (not shown) for pressurizing tank 12 (FIGS. 1–2).

A pressure gauge 82 is connected through filler cap 24 by a threadolet (not shown). Pressure gauge 82 is in fluid connection with tank 12 when filler cap 24 is connected to fill spout 20 for determining the pressure level within tank 12.

Figure 4:
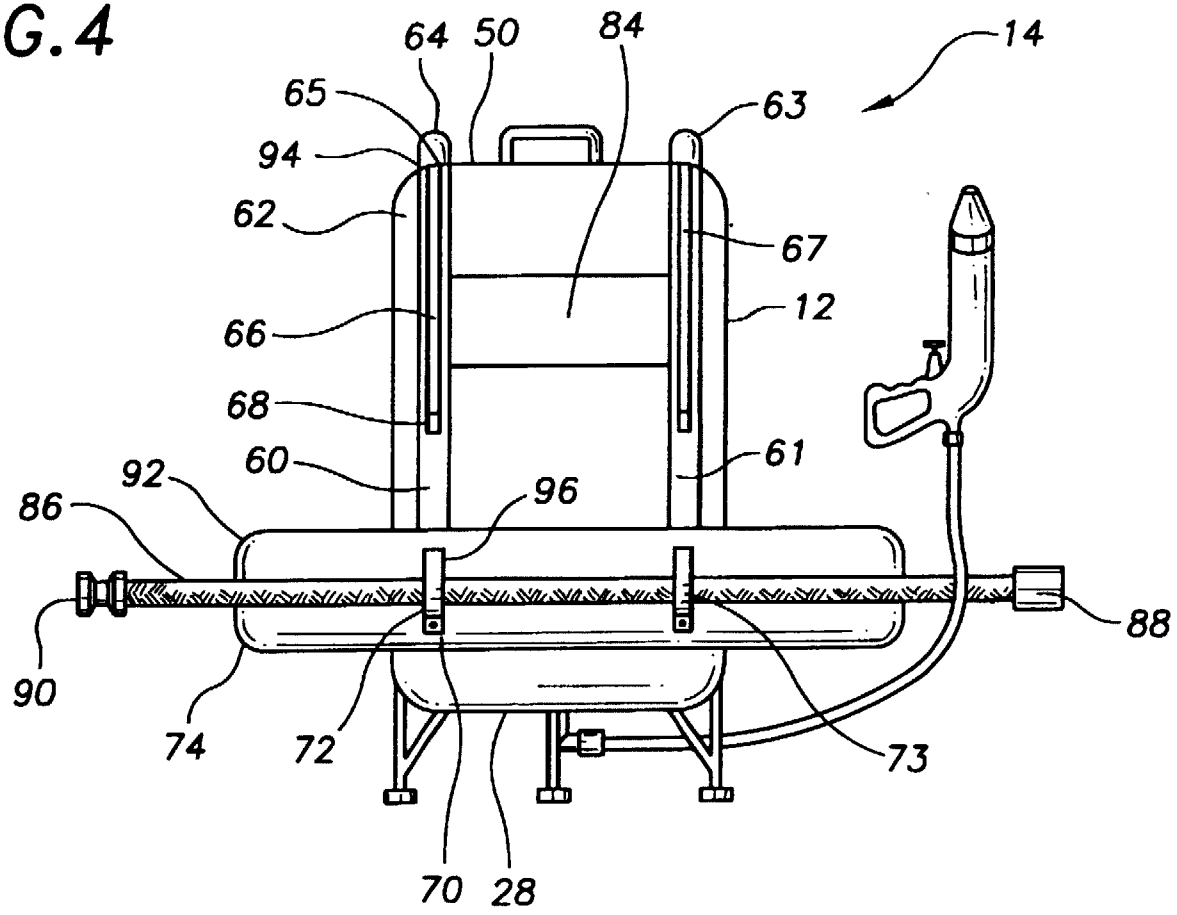
FIG. 4 is a front view of the back mounting apparatus.

FIG. 4 is a front view of back mounting apparatus 14. Back mounting apparatus 14 includes first and second frame members 60,61, first and second top shoulder straps 66,67 each having a buckle end 68, first and second bottom shoulder straps 72,73 each having a tongue end 70, a back brace 84, waist band 74, and a belt 86 having a female connector end 88 and a male connector end 90.

First and second frame members 60,61 are spaced parallel to one another and connected vertically to front surface 62 of tank 12 by welding. First frame member 60 has a first curved section 64 as shown in FIG. 2. Second frame member 61 has a second curved section 63. First and second curved sections 64,63 extend away from front surface 62 adjacent top section 50. Back brace 84 is made of nylon and is connected between first and second frame members 60,61 for spacing tank 12 from the back of the user.

Waist band 74 is made of padding encased in nylon and is attached to front surface 62 adjacent base section 28 by glueing. Belt 86 is connected to the exterior surface 92 of waist band 74 by stitching along the center longitudinal axis of waist band 74. Female connector end 88 and male connector end 90 are interconnectable for securing belt 86 and waist band 74 about the waist of a user.

Back mounting apparatus 14 is secured about the user's shoulders by interconnecting first top shoulder strap and first bottom shoulder strap 66,72 and interconnecting second top shoulder strap and second bottom shoulder strap 67,73 as shown in FIG. 2. First top shoulder strap 66 has an initial end 94 connected to distal end 65 of first curved section 64. Second top shoulder strap 67 has an initial end 94 connected to distal end 65 of second curved section 63. First bottom shoulder strap 72 is vertically aligned with first top shoulder strap 66 and has a first end 96 connected to exterior surface 92 of waist band 74. Second bottom shoulder strap 73 is vertically aligned with second top shoulder strap 67 and has a first end 96 connected to exterior surface 92 of waist band 74.

A method of suppressing a fire using fire suppressor 10 is now described with reference to FIGS. 1–4. A user (not shown) removes filler cap 24 and loads a fine grain sand as is used for sand blasting through the filler opening in fill spout 20, partially filling tank 12. Filler cap 24 is then threaded onto fill spout 20 sealing the fill opening through fill spout 20. A source of pressurized gas (not shown), such as an air compressor, is connected to valve 80, pressurizing tank 12. Once the tank is pressurized to the desired level the pressurized gas source is disconnected from valve 80.

Tank 12 may then be mounted on the user's back with first and second curved sections 64,63 resting atop the user's shoulders. First top shoulder strap 60 is connected to first bottom shoulder strap 72 by interconnecting the respective buckle and tongue ends 68,70; the process is repeated for interconnecting second top and bottom shoulder straps 67,73. Belt 86 and waist band 74 are then secured about the waist of the user by interconnecting male connector end 90 and female connector end 88 of belt 86.

The user then points nozzle 44 of suppressant discharge head 18 at the base of a fire. The user depresses trigger 46 discharging sand under pressure from tank 12 through conduit connector 26, flexible conduit 16, and through suppressant discharge head 18. By releasing pressure from trigger 46 the discharge of fire suppressant containing sand is halted.

It can be seen from the preceding description that a method and device for extinguishing fires which has a high pressure tank mountable on a user's back, has a suppressant discharge head for selectively discharging a fire suppressant, has a fill spout for filling the tank with a common, inexpensive fire suppressant such as sand, and has a valve in fluid connection with the tank for pressurizing the fire suppressant from a common source of pressurized fluid such as an air compressor has been provided.

It is noted that the embodiment of the fire suppressor described herein in detail for exemplary purposes is of course subject to many different variations in structure, design, application, and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A pressurized fire suppressor mountable on a user's back for selectively discharging a fire suppressant toward a fire, and which has a reservoir for holding said fire suppressant under pressure, said fire suppressor comprising:

a high pressure tank defining the reservoir therein for holding said fire suppressant, said tank having a fill spout defining a fill opening;

a filler cap connectable to said fill spout for sealingly covering said fill opening;

a valve in fluid connection with said tank, said valve extending through a top surface of said filler cap and being in connection therewith;

a flexible conduit having first and second connector ends, said first connector end being in fluid connection with said tank;

a suppressant discharge head for selectively discharging said fire suppressant from said tank, said suppressant discharge head being in connection with said second connector end of said flexible conduit; and a back mounting apparatus connected to said tank.

2. The fire suppressor of claim 1, further including:

a pressure gauge in fluid connection with said tank for determining the pressure within said tank.

3. The fire suppressor of claim 2, wherein:

said pressure gauge extends through said top surface of said filler cap and is connected thereto.

4. The fire suppressor of claim 3, further including:

three legs extending from a base section of said tank, each of said three legs having a terminal end including a horizontal foot member connected thereto.

5. The fire suppressor of claim 3, wherein said back mounting apparatus includes:

a first frame member having a first curved section;

a second frame member having a second curved section;

a waist band having an exterior surface, said waist band being connected to a front surface of said tank;

a belt having a female connector end and an interconnectable male connector end, said belt being connected to said exterior surface of said waist band;

a first top shoulder strap having a first initial end and a first buckle end, said first initial end being connected to a first distal end of said first curved section of said first frame member;

a second top shoulder strap having a second initial end and a second buckle end, said second initial end being connected to a second distal end of said second curved section of said second frame member;

a first bottom shoulder strap having a first shoulder strap end and a first tongue end, said first shoulder strap end being connected to said exterior surface of said waist band, said first tongue end being connectable with said first buckle end; and a second bottom shoulder strap having a second shoulder strap end and a second tongue end, said second shoulder strap end being connected to said exterior surface of said waist band, said second tongue end being connectable with said second buckle end;

said first and second frame members being spaced parallel to one another and connected vertically along said front surface of said tank, said first and second curved sections extending away from said front surface adjacent a top section of said tank.

6. The fire suppressor of claim 3, wherein:

said suppressant discharge head includes:

an enlarged barrel for gripping; and a pistol grip.

7. A pressurized fire suppressor mountable on a user's back for selectively discharging a fire suppressant toward a fire, and which has a reservoir for holding said fire suppressant under pressure, said fire suppressor comprising:

a high pressure tank defining said reservoir therein for holding said fire suppressant, said tank having a fill spout defining a fill opening;

a filler cap having a top surface, said filler cap being connectable to said fill spout for sealingly covering said fill opening;

a valve extending through said top surface of said filler cap and connected thereto, said valve being in fluid connection with said tank when said filler cap is connected to said fill spout a pressure gauge extending through said top surface of said filler cap and connected thereto, said pressure gauge being in fluid connection with said tank when said filler cap is connected to said fill spout for determining the pressure within said tank;

a flexible conduit having first and second connector ends, said first connector end being in fluid connection with said tank;

a suppressant discharge head for selectively discharging said fire suppressant from said tank, said suppressant discharge head being in connection with said second connector end of said flexible conduit;

three legs each having a horizontal foot member, said legs extending from a base section of said tank;

a handle in connection with a top section of said tank; and a back mounting apparatus connected to said tank, said back mounting apparatus including:

a first frame member having a first curved section;

a second frame member having a second curved section;

a waist band having an exterior surface, said waist band being connected to a front surface of said tank;

a belt having a female connector end and an interconnectable male connector end, said belt being connected to said exterior surface of said waist band;

a first top shoulder strap having a first initial end and a first buckle end, said first initial end being connected to a first distal end of said first curved section of said first frame member;

a second top shoulder strap having a second initial end and a second buckle end, said second initial end being connected to a second distal end of said second curved section of said second frame member;

a first bottom shoulder strap having a first shoulder strap end and a first tongue end, said first shoulder strap end being connected to said exterior surface of said waist band, said first tongue end being connectable with said first buckle end; and a second bottom shoulder strap having a second shoulder strap end and a second tongue end, said second shoulder strap end being connected to said exterior surface of said waist band, said second tongue end being connectable with said second buckle end;

said first and second frame members being spaced parallel to one another and connected vertically along said front surface of said tank, said first and second curved sections extending away from said front surface adjacent said top section of said tank.

8. The fire suppressor of claim 7, wherein:

said fire suppressant includes:

a fine grain sand carried in said pressurized fluid.

* * * * *